US005529300A

United States Patent [19]

Frazier et al.

[11] Patent Number: 5,529,300

[45] Date of Patent: Jun. 25, 1996

[54] SELF-POWERED EXTENSIBLE PROJECTILE LAUNCHING POLICE BATON

[76] Inventors: Richard K. Frazier, 1 Research Dr., Dartmouth, Nova Scotia, Canada, B2Y 4M9; Arnold W. Trottier, 2424 Nugget Loop, Fairbanks, Ak. 99709; Barry V. Davis, 31 Garden Court Terrace, Dartmouth, Nova Scotia, Canada, B3A 3S6

[21] Appl. No.: 323,740

[22] Filed: Oct. 17, 1994

[51] Int. Cl.[6] ..... F41B 11/06; F41B 15/02

[52] U.S. Cl. ..... 273/84 R; 124/56; 124/61; 42/1.16

[58] Field of Search ..... 273/84 R; 124/56, 124/60, 61, 64, 65, 72, 74; 42/1.12, 1.16, 52

[56] References Cited

U.S. PATENT DOCUMENTS

| | | | |
|---|---|---|---|
| 83,228 | 10/1868 | Warne . | |
| 2,924,211 | 2/1960 | McSwain | 124/61 |
| 3,088,440 | 5/1963 | Wilmer . | |
| 3,371,930 | 3/1968 | Shiga . | |
| 3,609,901 | 10/1971 | Necas . | |
| 3,707,794 | 1/1973 | Rocha et al. . | |
| 3,728,809 | 4/1973 | Mulich et al. . | |
| 3,895,454 | 7/1975 | Hancox . | |
| 4,037,839 | 7/1977 | Nelson . | |
| 4,086,682 | 5/1978 | Hancox . | |
| 4,819,137 | 4/1989 | Hamilton . | |
| 4,890,778 | 1/1990 | Hawkins . | |
| 5,230,324 | 7/1993 | Van Horssen et al. | 124/61 |

*Primary Examiner*—V. Millin
*Assistant Examiner*—William M. Pierce
*Attorney, Agent, or Firm*—Ronald P. Kananen

[57] ABSTRACT

A baton-like device is provided with a hollow telescopic ram or bolt member which can be driven to extend out of a barrel or trunk portion of the baton. The driving force is produced by a source of gas under pressure, which in preferred embodiments, takes the form of explosive cartridges and which can be repeatedly and automatically operated in a manner similar to an automatic shot gun. The force with which the ram is driven can be modulated using a pressure by-pass or by selection of the cartridges, or both. In order to reduce the risk of a fatal impact, the tip of the ram is provided with a blunt knob which can further include an inflatable cushion like member which is supplied with air or gas as the ram is displaced out of the barrel. The knob is removable allowing projectiles such as tranquilizer darts to be launched by loading the projectile into the hollow bolt and catapulting them towards a target or targets. Alternatively, the knob can be replaced with a chisel-like cutting tool and used as an emergency cutter in the event of a vehicle accident.

19 Claims, 11 Drawing Sheets

SELF-POWERED EXTENSIBLE PROJECTILE LAUNCHING POLICE BATON

BACKGROUND OF THE INVENTION

1. Field of the Invention

The present invention relates generally to a non-lethal instrument for use by civil and military police and peace-keeping forces. More specifically, the present invention relates to a self-extending baton or night stick type of device which can be used in close quarters to stun an opponent without inflicting a fatal or serious injury.

2. Description of the Related Art

U.S. Pat. No. 3,371,930 issued on Mar. 5, 1968, to Shiga, U.S. Pat. No. 4,037,839 issued on Jul. 26, 1977, and U.S. Pat. No. 4,819,137 issued on Apr. 4, 1989, to Hamilton, disclose examples of extensible batons or night sticks. These devices have the advantage that when not in use they can be conveniently reduced in length and carried or concealed from view. However, these devices are in effect no more effective in emergency situations than the more conventional non-collapsible types and require the same amount of strength and ability to use effectively.

U.S. Pat. No. 3,728,809 issued on Apr. 24, 1973 to Mulich et al. discloses a projectile launcher baton which includes a firing mechanism capable of propelling a flexible low lethality projectile against a target such as assailant, fugitive or the like. While this arrangement is also capable of doubling as a night stick, it suffers from the drawbacks that the barrel is relatively large in diameter making it quite conspicuous, it is not collapsible, and requires some time and trouble to reload after a single use.

While other forms of hand-held stun devices, which produce a high voltage discharge between electrodes mounted at one end of the device, are known, these devices require the user to be in extremely close quarters with an assailant in order that they be rendered effective to incapacitate a person.

SUMMARY OF THE INVENTION

Accordingly, it is an object of the present invention to provide a device which can be used as a conventional baton or night stick and which is capable of powered self-extension and delivering a very rapid and powerful blow sufficient to incapacitate even a large and powerful opponent.

It is a further object of the invention to provide a baton-like device which is capable of automatic rapid repeated self-powered extensions without the need to reload between each extension.

It is another object of the present invention to provide a baton-like device which is capable of being reloaded quickly and easily.

It is a further object to provide a baton of the above-mentioned nature which can be adjusted in a manner which controls the power with which each of the extensions is made.

Another object of the invention is to provide a baton of the above mentioned type wherein a resilient member at the working end of the baton can be automatically inflated in response to the extension of the baton in a manner which reduces the risk of serious injury to the party being struck.

It is yet another object of the invention to provide the above-mentioned type of baton-like device which can be quickly converted to a launching device which can "catapult" projectiles such as tranquilizer darts or pitons toward selected targets.

It is still another object of the invention to construct the above mentioned type of baton in a manner that it can be quickly converted to a cutting tool which can be used in emergency situations such as plane crashes or automotive vehicle accidents.

In brief, the above objects are achieved by an arrangement which is basically similar to a baton such as used by police, and which is provided with a hollow telescopic ram or bolt member which can be driven to extend out of a barrel or trunk portion of the baton. The driving force is produced by a source of gas under pressure which, in preferred embodiments, takes the form of explosive cartridges. The source is arranged to be repeatedly and automatically operated in a manner similar to an automatic shot gun. The force with which the ram is driven is advantageously modulated using a pressure by-pass or by selection of the cartridges, or both. In order to reduce the risk of a fatal impact on a human, the tip of the ram can be provided with a blunt knob which can further include an inflatable cushion-like member which is supplied with air or gas as the ram is displaced out of the barrel.

In alternative forms of the invention, the knob is removable allowing projectiles such as tranquilizer darts to be launched by loading the projectile into the hollow bolt and catapulting it towards a target. Alternatively, the knob can be replaced with a chisel-like cutting tool and used as an emergency cutter in the event of a vehicle accident.

More specifically, a first aspect of the invention resides in a device comprising: a first elongate member having a hand grip portion; a second elongate member reciprocatively disposed in the first member in a manner to define a telescopic arrangement, the second member having an inboard end disposed in the first member and an outboard end, the first member being adapted to be driven by gas pressure in the first member and which is applied to the inboard end so to extend out of the first member by a predetermined distance, the second member being hollow and effective to interchangeably receive a projectile therein or have a third member rigidly connected to the outboard end; biasing means for biasing the second member toward a fully retracted position wherein the amount of projection of the second member out of the first member is minimized; and a source of gas under pressure operatively disposed in the first member which is responsive to a manually manipulatable member disposed on the hand grip portion, the source including a magazine containing a plurality of gas generating cartridges and a firing mechanism which is responsive to the second member assuming the fully retracted position to cause the plurality of gas generating cartridges to sequentially detonate and generate gas within the first member.

A second aspect of the invention resides in a device comprising: a first elongate member; a second elongate member reciprocatively disposed in the first member in a manner to define a telescopic arrangement; a source of gas under pressure operatively disposed in the first member which is responsive to a manually manipulatable member disposed on the first member and which selectively releases gas under pressure into the first member in a manner which drives the second member to slide in the first member and to project outward; and a knob disposed at an end of the second member which is effective for delivering a non-fatal disabling impact to a human body.

A third aspect of the invention resides in a device comprising: a handle; an elongate essentially cylindrical barrel fixedly connected to the handle; an elongate hollow cylindrical ram reciprocatively disposed in the barrel; a spring for causing the ram to slide into the barrel; a knob removably attached to an outboard end of the ram, the knob being so dimensioned as to be effective to disperse the impact which is applied to a human body, the knob having an expandable elastomeric cover disposed thereover in a manner to be inflatable in response to the supply of air under pressure through a bore which extends axially along the ram, the knob being removable to allow one of (a) a projectile be to loaded into the bore in the ram through an open end of the ram, and (b) a cutter to be attached to the ram in place of the knob; a stepped piston slidably disposed in the barrel and connected to an inboard end of the ram, the stepped piston having a first face which is exposed to a gas pressure selectively developed in the barrel and a second face which is exposed to an annular space which is defined between the barrel and the outer periphery of the ram; and passage means including the bore in the ram, for delivering air in the annular space to inflate the inflatable elastomeric cover when the ram is driven to extend out of the barrel in response to the application of a gas pressure on the first face.

BRIEF DESCRIPTION OF THE DRAWINGS

The present invention will become more clearly appreciated as a description of the preferred embodiment is made with reference to the appended drawings in which.

DETAILED DESCRIPTION OF THE PREFERRED EMBODIMENT

Figure 1:
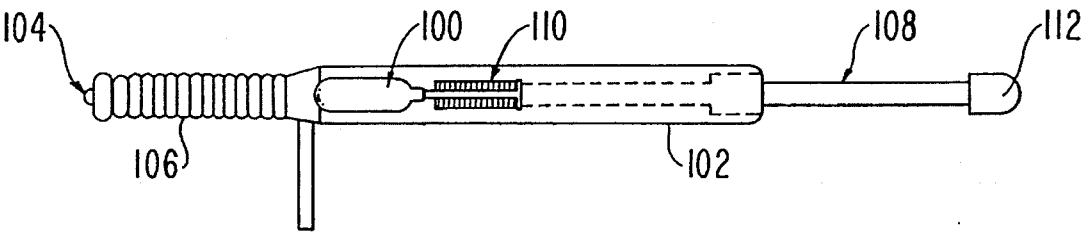
FIG. 1 is schematic illustration of a first embodiment of a baton-like device suitable for police use according to the present invention.

A first embodiment of the invention is shown in FIG. 1. This arrangement features a construction which is essentially similar to a "tonfa" type baton which is in current widespread use by police forces. In this embodiment, a gas cylinder 100 is disposed in the main body or barrel 102 of the baton and is operatively connected with an activation button or trigger member 104 which is provided at the base of a hand grip 106, by way of a non-illustrated mechanism. In this figure the bolt or ram 108 is shown fully extended from the barrel 102. A return spring 110 which is provided to automatically retract the bolt 108 into the barrel 102 is shown connected to an end of the bolt. In this case the spring 110 is a tension spring and becomes elongated as the bolt 108 moves out of the barrel 102.

Figure 2:
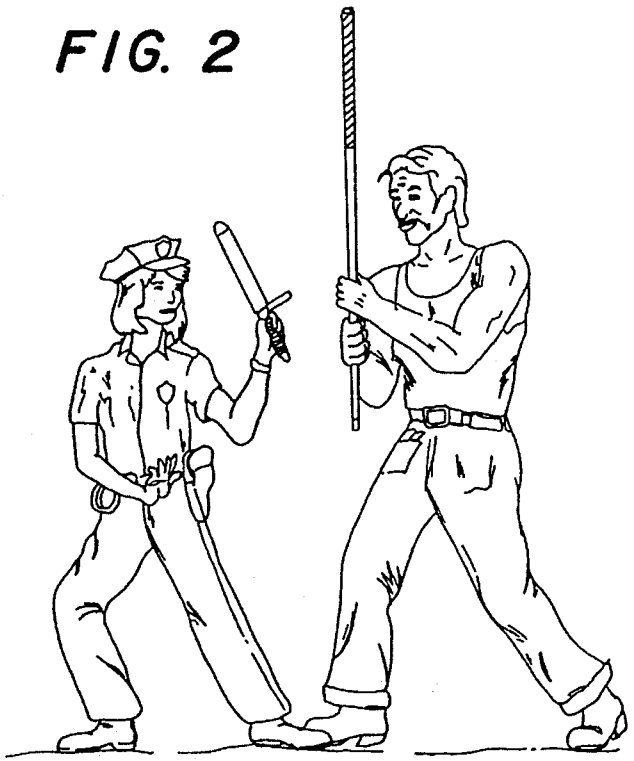
FIGS. 2 and 3 are sketches showing a possible application of baton-like device according to the present invention.
Figure 3:
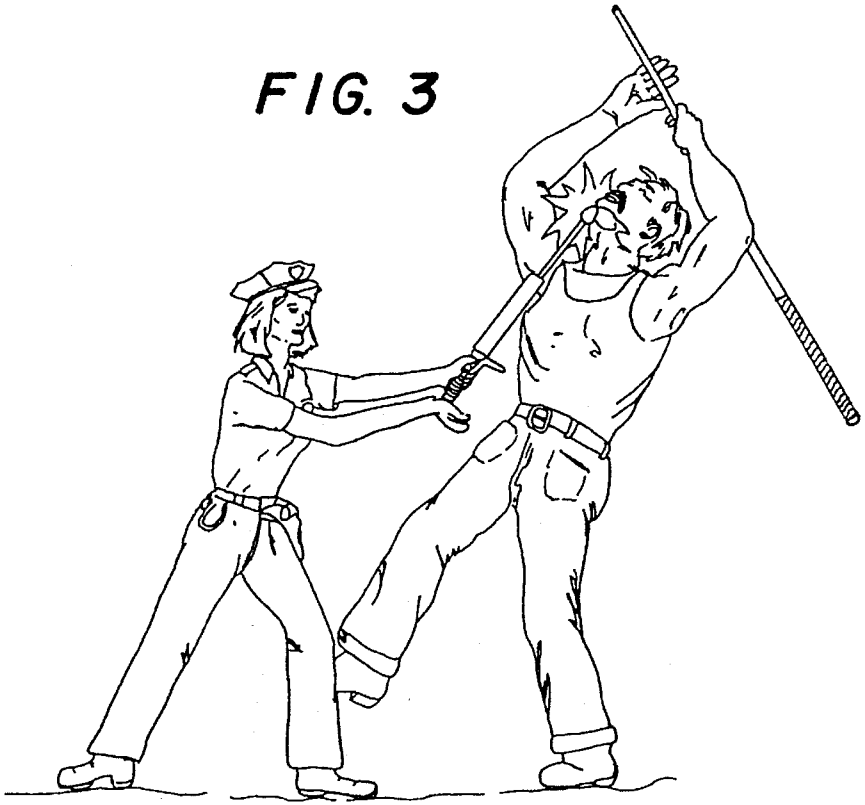

As will be appreciated, it is possible for this baton to be used as a conventional baton as shown in FIG. 2, or as a "power puncher" in the manner illustrated in FIG. 3. In accordance with the first embodiment of the invention, the provision of the trigger or activation button 104 at the end of the hand grip 106 allows an operator to activate the weapon using the heel of the hand, and thus naturally provides resistance to the recoil. The tip of the bolt 108 or ram is provided with a knob 112 which is sufficiently blunt as to disperse the force applied by the bolt 108 over a surface area selected to provide a non-fatal impact. It is possible to form this knob 112 of either metal, rubber, synthetic, or a combination of these materials.

It should be noted however, that as different from FIG. 3, it may be preferable in actual practice that the "power puncher" is aimed at an area between the clavicle and waist areas of a protagonist as different from the jaw or throat.

SECOND EMBODIMENT

Figure 4:
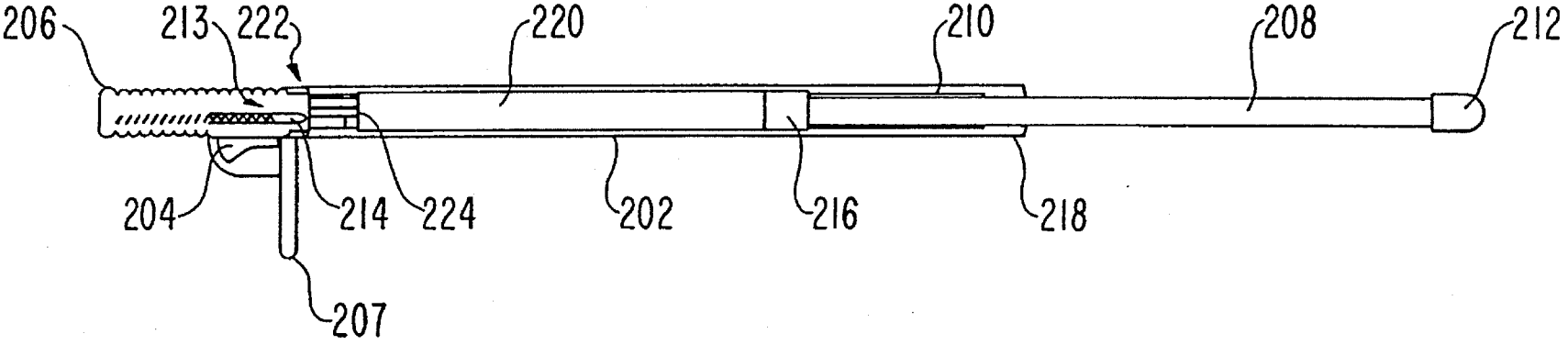
FIG. 4 schematically shows a second embodiment of the present invention.
Figure 5:
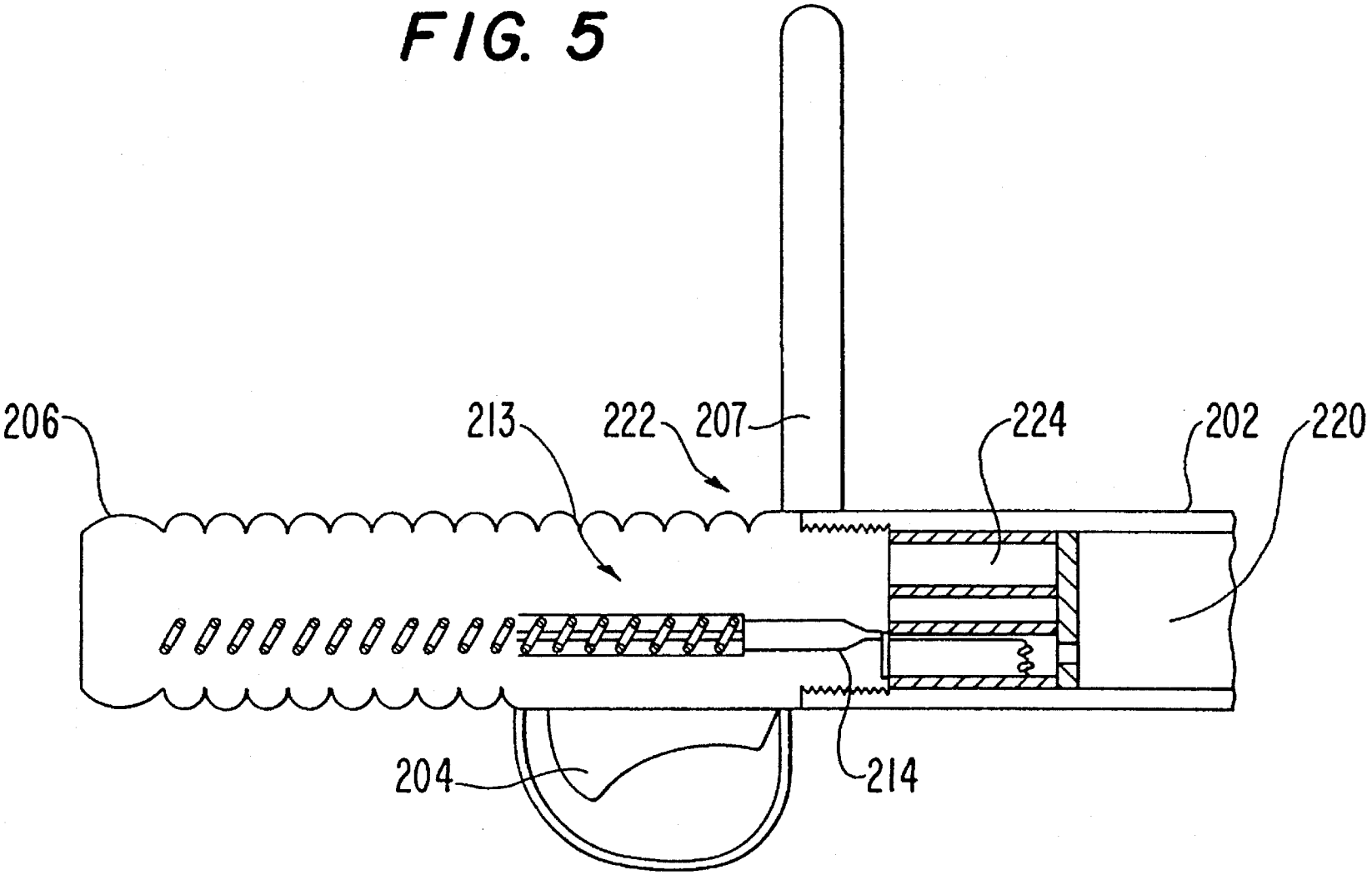
FIG. 5 is an enlarged view showing details of the grip portion of the second embodiment.
Figure 6:
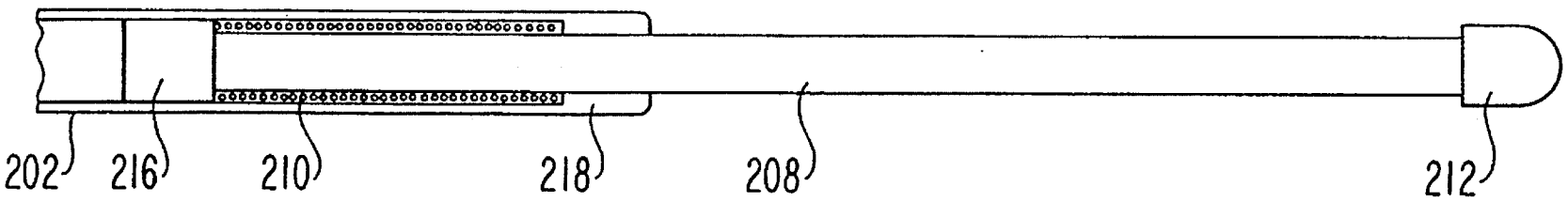
FIG. 6 is a schematic view showing a baton-like device according to the second embodiment in a fully extended condition.
Figure 7:
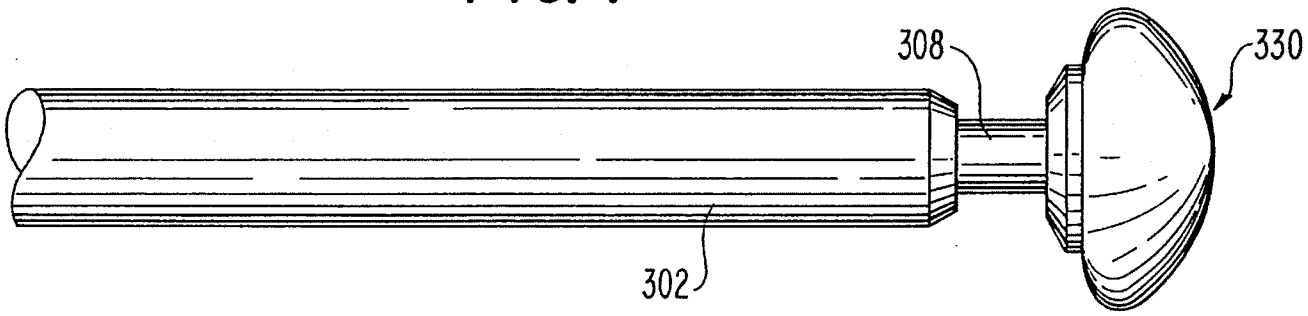
FIGS. 7 and 8 are plan views showing a third embodiment of the present invention.

FIGS. 4 to 6 show a second embodiment of the invention. This arrangement is basically similar to that of the first embodiment but differs in that the gas pressure required to force bolt 208 out to its fully extended position, is produced by explosive charges contained in so called "crimped" cartridges instead of being released from a compressed gas cylinder. These "crimped" cartridges are commercially available, contain no projectile and are know for their application in grenade launchers.

The mechanism, generally denoted by the numeral 213, used to fire the charges is in this instance, basically similar to that used in a double action revolver wherein pulling the trigger will rotate a multi-cartridge magazine and timely cause a firing pin to strike the rim of a rim fire type cartridge. In this embodiment, the return spring 210 is, as illustrated in FIG. 6, disposed in an annular space defined between the outer periphery of the bolt 208 and the inner periphery of the barrel 202. One end of the spring 210 rests against a piston member 216 which is provided at the inboard end of the bolt 208, while the other end bears against a shoulder defined by a barrel end cap 218.

When a cartridge is struck by the firing pin 214, the gas which results from the very rapid combustion of the charge in the cartridge, is released into a chamber 220 that is defined between the breach section 222 of the device and the piston member 216 provided at the end of the bolt 208.

Although not shown, it is of course within the scope of present invention to arrange for the breach 222 to be such that the revolving chamber 224 in which the cartridges are disposed, can be pivoted laterally out to one side to facilitate reloading. Alternatively, the baton can be arranged to "break" like a shot gun.

It will be appreciated that the handle 207 which extends at right angles to the main body of the device is shown in an alternative position in FIG. 5.

THIRD EMBODIMENT

FIGS. 7 to 11 show details of a third embodiment of the invention. One of the features of this embodiment is that the breach sections 352A and 352B are arranged to "break" to allow a disposable magazine 324 to be removed and replaced with a fresh fully loaded unit. The utility of the "speed loading" which is enabled by this arrangement will be appreciated by those familiar with law enforcement for example.

Figure 11:
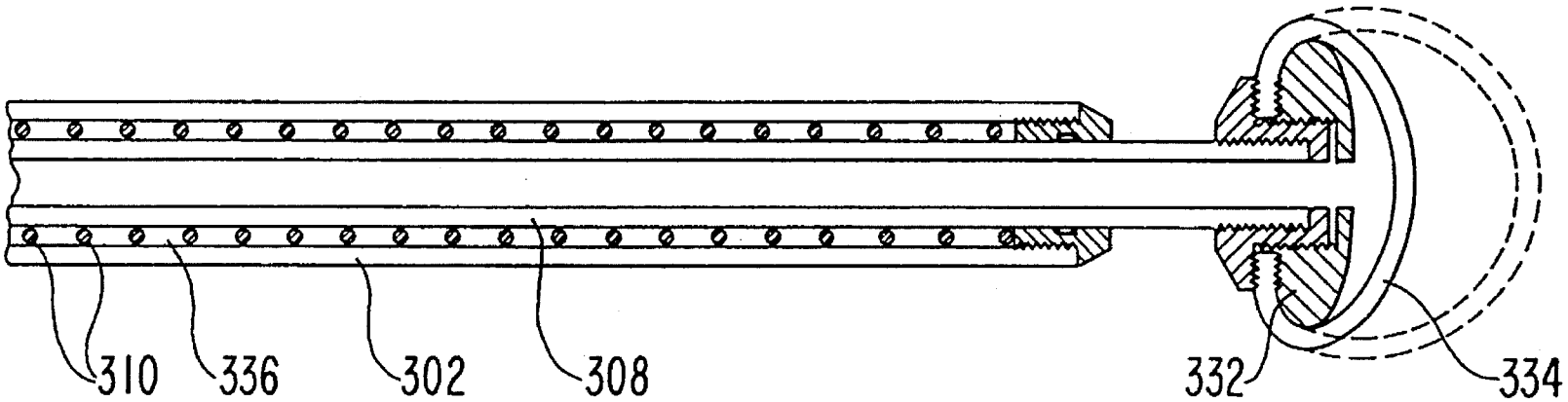
FIG. 11 is a sectional elevation showing a knob construction which can be used with the third embodiment.

This embodiment also features the use of a so called "puffer" 330 or inflatable cushion member which is provided at the tip of the bolt 308. As best seen in FIG. 11, the "puffer" 330 consists of a knob 332 made of a hard material such as stainless steel, and which is machined so as to have a smooth convex surface that is sufficiently large to enable the force with which the bolt is driven, to be spread sufficiently upon contact with the human anatomy so as to reduce the risk of the blow being fatal. This knob 332 can be enclosed in an elastomeric cover or "puffer" 334 made of urethane for example, which can be inflated from the state illustrated in solid line to that illustrated in broken line.

The "puffer" 334 is inflated in response to the outward displacement of the bolt 308. A stepped piston member 316 which is connected to the end of the bolt 308 is such that as it moves toward the end of the barrel 302, the air which is entrapped in the annular space 336 defined between the bolt 308 and the inner periphery of the barrel 302, is displaced through transfer ports 338 that are drilled at strategic locations along the bolt 308, into the elongate bore 340 which extends the length of the bolt 308. This displacement of the air from the annular space 340 thus inflates the "puffer" 334.

The "puffer" 334 serves a number of different purposes. It softens the blow dealt by the power puncher to even further reduce the risk of a fatal blow being delivered, and also increases the reach of the device. It additionally eliminates the need to provide blow off holes near the leading end of the barrel 302, prevents contaminants and debris from entering the barrel 302, and also acts as an air spring which assists in returning the bolt 308 to the ready position.

The inboard end of the bore 340 is closed by the provision of a spring biased reload pin arrangement 342 which is used to re-cock the firing mechanism, generally denoted by numeral 344, and to rotate the magazine 324 to the next firing position when the bolt 308 is returned to its home position under the influence of the return spring 310. It will be noted that an end of the reload pin 342 is in abutment with an auto reload plunger pin 346 which forms part of firing mechanism 344. Accordingly, it is possible to manually cock the firing mechanism simply by forcing the bolt 308 into the barrel 302 against the bias of a reload drive pin shock spring 348 which is disposed in the bore 340 of the bolt 308 and a rebound spring 350 which is disposed between the forward breach unit 352A and a shoulder of the:stepped piston 316. This, of course, can be done by hand or by pressing the business end of the bolt 308 against the ground or a wall.

The forward and rear breach units 352A, 352B are pivotally connected by a breach hinge pin 354. A thumb operated spring loaded breach lock 357 is arranged on the upper side of the forward breach unit to facilitate ready opening of the breach. The breech is arranged to receive the disposable magazine 324 which in this embodiment is arranged to hold ten (10) of the above mentioned "crimped" cartridges 356. The cartridges may be supplied by various manufacturers of "RAMSET" type fastening tools.

The crimped cartridges 356 come in a number of charge levels and thus enable various levels of gap pressure generation.

The disposable magazine together with the reloading and cocking mechanism form integral and essential components of this embodiment of the invention.

Immediately ahead of the breach is a partially knurled sleeve 358 which acts as part of a power regulator valve. This sleeve 358 contains various openings, for example 360*a*, 360*b*, 360*c*, and 360*d*, shown in FIG. 8, each of diminishing size. A detent spring 362 allows the sleeve to be rotated, for example, to five different settings. The openings 360*a* to 360*d*, which have successively smaller diameters, can be brought into registry with a large diameter orifice passage 364 which is drilled through the barrel. As the sleeve 358 is rotated, the size of the passage which communicates with the ambient atmosphere is reduced, thus reducing the amount of gas which can be vented from the breech (in this case by turning the pressure regulator clockwise).

Figure 8:
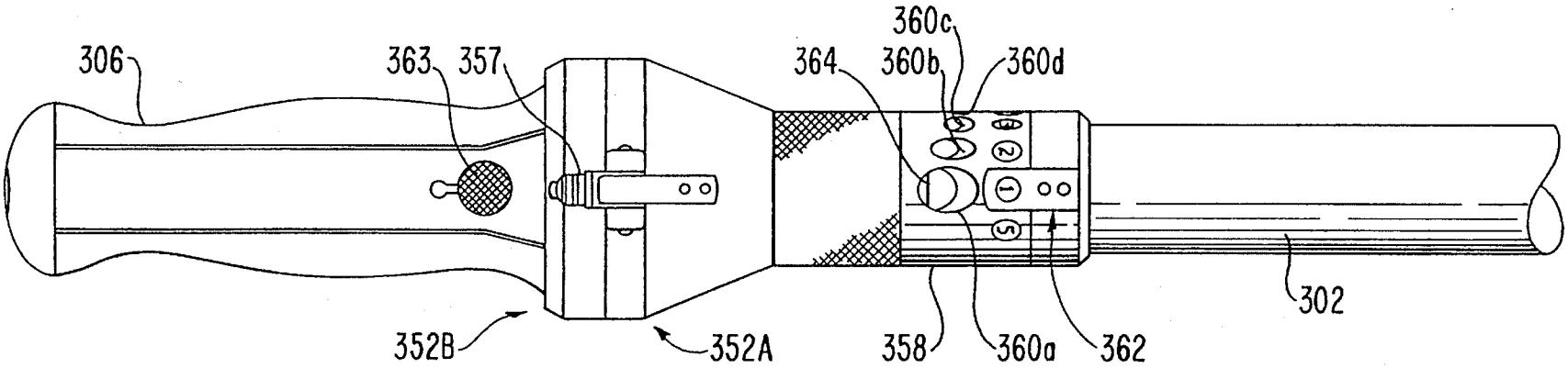

As will be appreciated from FIG. 8, setting No. 1 permits the maximum amount of gas to be vented and thus provides the lowest power setting. Settings 2 to 4 each provide progressively increased resistance to gas flow and thus stepwisely increase the amount of bolt displacement power. Setting No. 5, on the other hand, is such as to prevent gas release and thus enables maximum power to be developed.

It will be noted that when the power regulator sleeve 358 is set to any one of the positions 1 to 4, the escaping gases will produce a shrill noise. Setting 1, wherein the maximum amount of gas is permitted to be vented, may produce the greatest amount of noise and can be useful for surprising and disorienting a protagonist.

The combination of the different cartridge charge levels and the selective venting of gas generated allows the power generated by the power puncher to be controlled over a large combination of different levels which may vary from a warning tap to a bone braking impact.

A safety lock button 363 is operatively connected with the firing mechanism 344 and which can be set to prevent accidental discharge.

In operation, when the trigger 304 is pulled the firing pin 314 is released and allows a firing pin spring 315 to drive it against the rim of a cartridge 356. The detonation of the charge in the cartridge very rapidly generates a high gas pressure which drives the bolt 308 along the barrel 302. Depending on the setting of the power regulator sleeve 358, some of the gas is vented to the atmosphere. As the bolt 308 moves down the barrel 302, the air which is contained in the annular space 336 is pumped into the hollow interior of the bolt 308 and supplied to the puffer 334. The displacement of the bolt 308 also compresses the return spring 310.

After reaching its fully extended position and beginning to return to the its home position under the bias of the return spring 310, the air which has inflated the puffer 334 is allowed to exhaust back into the annular space 336 and assist the return of the bolt 308 to its home position. As this happens the puffer 334 shrinks back to its original size. The rebound spring 350 snubs the final portion of the return stroke of the bolt 308.

The reload pin 342 which is disposed in the inboard end of the bolt 308 drives the auto reload plunger 346 back into the handle assembly 306 against the return spring 373 and induces the recocking of the firing pin 314 and returns the plunger 346. As the firing pin 314 is moved back to a firing position, an angled slot in the reload angle plate 370 carried by plunger 346 and included in the firing mechanism 344, rotates the ratchet thimble 371 causing the ratchet teeth on the forward end of the thimble 371 to rotate and ride up and back (anti-clockwise) one set of teeth, by compressing the spring 372 and then snap back into the mating magazine ratchet in the magazine 324. When the reload pin 342 returns to its rest position the thimble 371 is rotated forward (clockwise) rotating the magazine 324 by an amount sufficient to bring the next cartridge into an operative position with respect to the firing pin 314. This ratchet arrangement between the thimble 371 and the magazine 324 maintains a constant operative connection with the magazine 324 and prevents undesirable movement.

Figure 12:
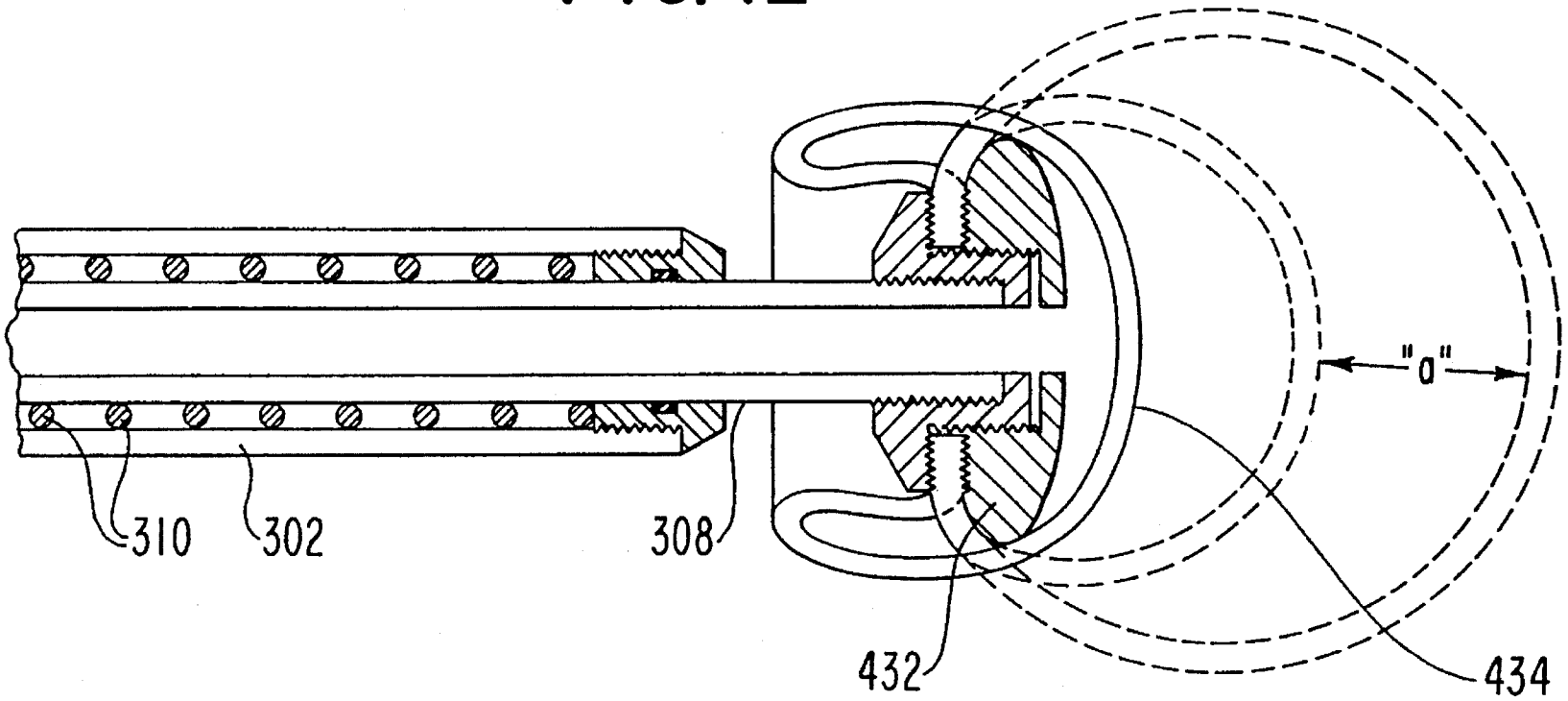
FIG. 12 is a sectional elevation showing a variant of a knob construction with can be used with the third embodiment.

FIG. 12 shows a variant of the puffer. In this arrangement the puffer 434 is shaped and arranged to fold back around the knob 432. Upon inflation, this arrangement is such that the puffer 434 projects further ahead of the outboard end of the bolt 308 and the knob 432 further than the puffer 334 of the embodiment shown in FIG. 11. This of course increases the reach of the device by the amount designated by "a".

Figure 9:
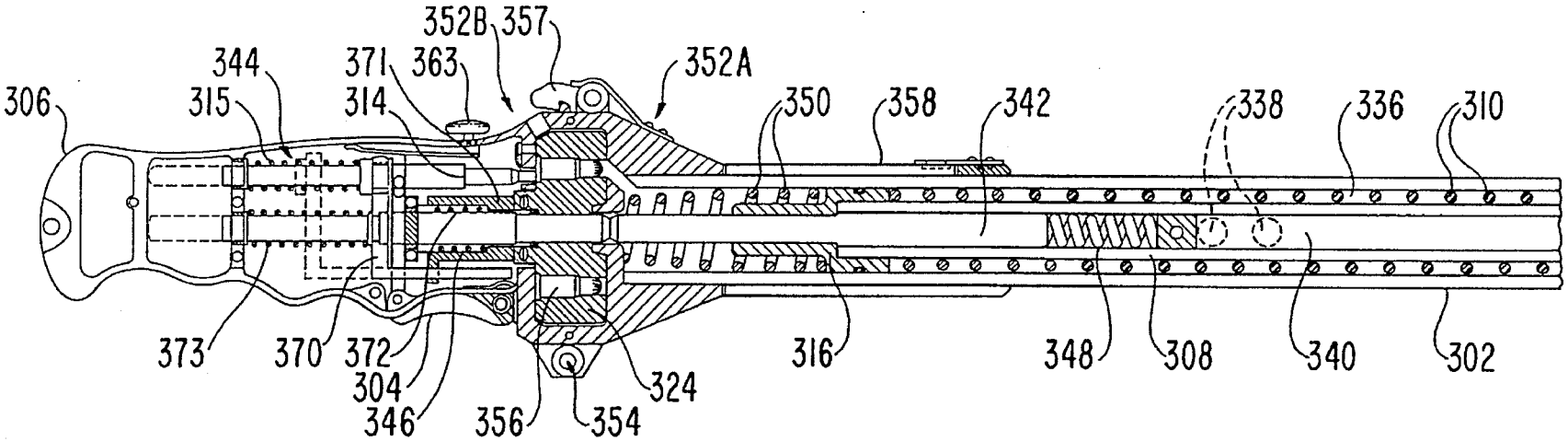
FIG. 9 is a sectional elevation showing details of the grip and barrel portion of the third embodiment of the invention.
Figure 10:
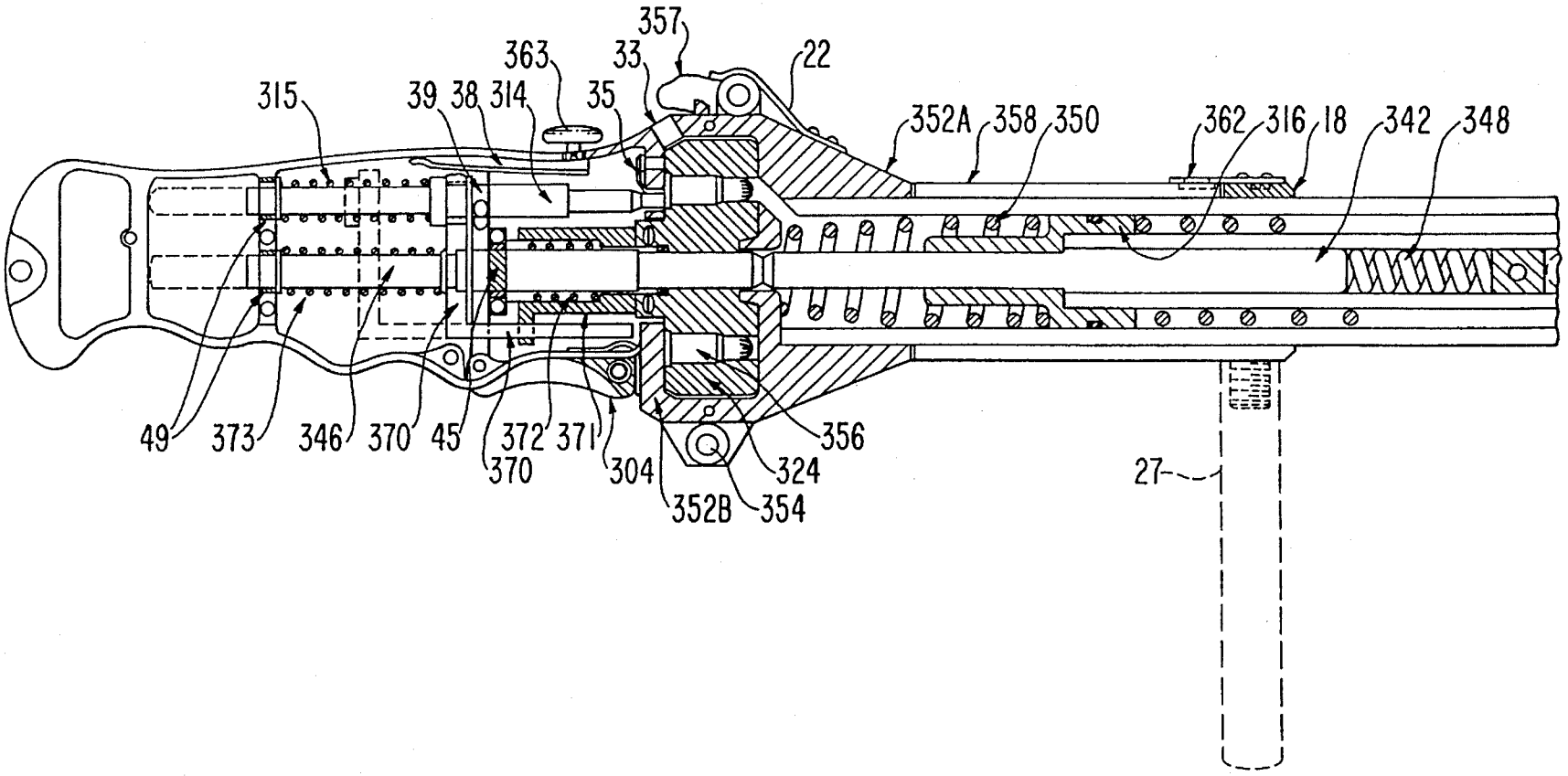
FIG. 10 is an enlarged view of the arrangement shown in FIG. 9 showing the provision of a handle.

In addition to the above-described structure, the arrangement shown in FIGS. 9 and 10 further includes a regulator locator ring 18, a breech lock spring 22, an auxiliary handle or hand hold 27, a quartz window 33 through which the position of the magazine 324 can be seen, a magazine locator detent 35, a safety lock spring 38, a trigger release plate 39, a stop plate 45, and bearings 49 which support the rear ends of the auto reload plunger 346 and firing pin 314.

ALTERNATIVE EMBODIMENTS

The present invention is not limited to use as a power puncher. By removing the knob and puffer, it is possible to drop a projectile into the "muzzle" of the bolt 308 and to use the catapult-like action which is produced by the rapid displacement of the bolt 308, in combination with the gas pressure which tends to develop in the bolt bore 340, to impart sufficient momentum on the projectile to cause the same to fly to a predetermined target. One example of a projectile is a tranquilizer dart. Usually rifles which are used to fire tranquilizer darts are of the bolt action single shot type. In an emergency, such as a large animal becoming accidentally loose, for example, it is often desirable to be able to fire a number of darts in order to rapidly stop a large beast and more pertinently to safeguard against misses or ineffective misplaced shots. The present invention allows darts to be launched as soon as they are dropped into the open muzzle of the bolt. Further applications of this catapult launching facet of the invention can be found in shooting pitons into place in rock climbing, and the like.

Figure 13:
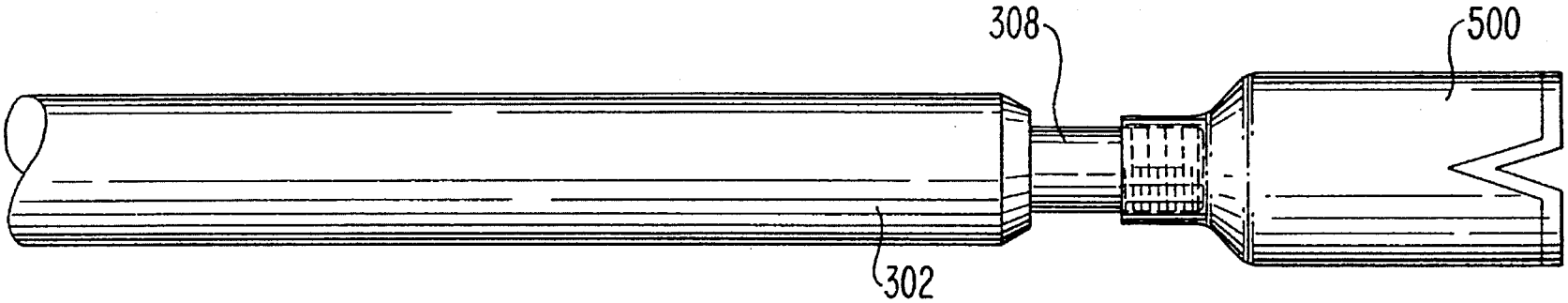
FIGS. 13 and 14 show an example of a cutter which can be attached to the end of the device in place of a knob.
Figure 14:
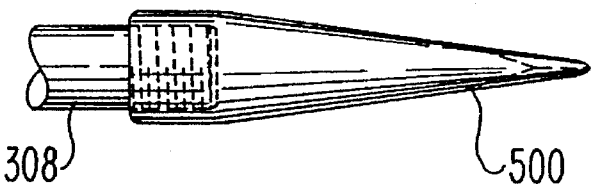

A further alternative, comes in replacing the knob and puffer unit with a cutter 500 of the nature shown in FIGS. 13 and 14. This variant finds application in cutting through damaged panels in the case wherein someone is trapped in a crashed and damaged vehicle. For example, a selected type of chisel head type cutter could be adapted for connection to the end of the bolt 308 in place of the knob 330. The rapidity with which the device can be fired of course lends itself to such situations wherein someone is trapped it may not be convenient to simply await the arrival of a rescue team.

The cutter 500 can have a wedge-shaped cross-section and a cutting edge having a profile such as that illustrated in FIG. 13, for example.

Figure 15:
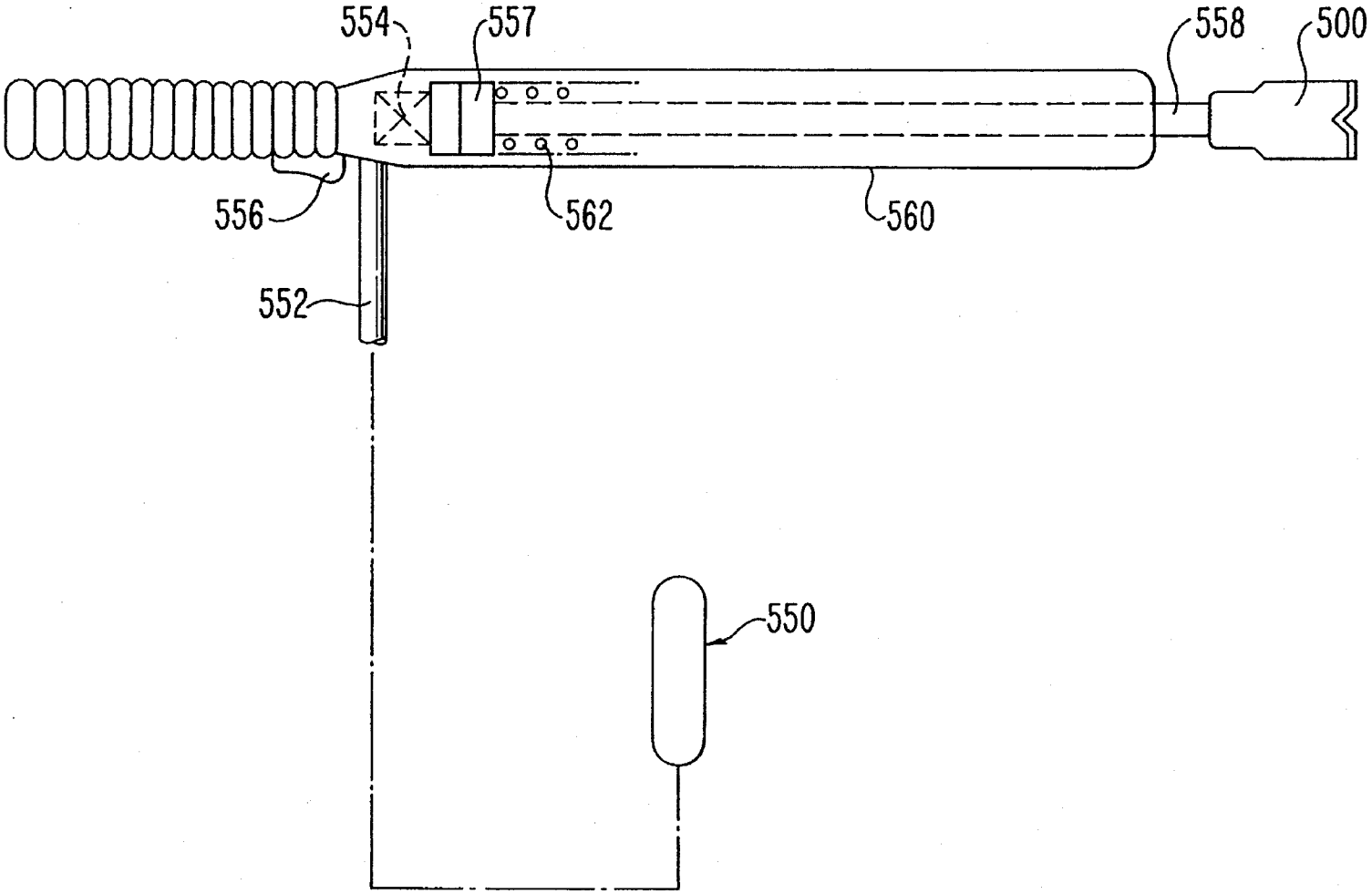
FIG. 15 shows an embodiment of the invention which is adapted to be operatively connected with an external source of gas under pressure.

FIG. 15 shows an embodiment of the invention which is adapted for connection to an external source of compressed gas. It is envisioned that in the event that the power puncher were required to be used for relatively long periods, rather than reloading a large number of times, it would be advantageous in emergency situations wherein a person or persons, for example, were to be trapped and rescuers were required to make a large number of cuts, or the environment was not conducive to the use of explosives (such as in fires for example) for a pneumatically powered version of the invention to be available.

The illustrated arrangement includes a source of gas under pressure 550. This source can take the form of an "Aqualung™" type of cylinder which can be worn on the back. It should be noted that the source is not limited to compressed air, nitrogen and the like. The source 550 is connected to the power puncher proper by way of a conduit 552. A valve 554 is operatively connected by way of an non-illustrated connection to a trigger 556. This valve 554 allows gas under pressure to be suddenly released into a chamber 557 in a manner which drives the ram 558 out of the main body 560 of the power puncher. A spring 562 similar to that illustrated in FIG. 11 for example, can be used to return the ram 558 to its original position. As will be readily appreciated, the valve 554 can be and preferably is arranged to suitably vent the chamber 557 into which the pressurized gas is introduced, upon the ram 558 reaching a predetermined amount of extension. This allows the ram 558 to quickly return and resume a position ready for the next strike.

The present invention may be adapted for underwater use as a shark "Billy". In this instance however, it would be necessary to provide additional seals such as a one-way valve which would allow the release of the gas generated within the device without the ingression of water.

It will clearly be understood by those skilled in the art that the invention is not limited to the preferred embodiments which have been described hereinabove and that various changes and modifications may be made without departing from the scope of the present invention which is to be limited only by the appended claims.

What is claimed is:

1. A device comprising:

a first elongate member having a hand grip portion;

a second elongate member reciprocatively disposed in said first member in a manner to define a telescopic arrangement, said second member having an inboard end disposed in said first member and an outboard end, said second member being adapted to be driven by gas pressure in said first member so as to be displaced within said first member and to extend out of said first member by a predetermined distance;

a third member connected to the outboard end of said second member;

projectile receiving means for receiving a projectile, said projectile receiving means comprising a hollow portion in the outboard end of said second member;

a spring disposed in said first member for biasing said second member toward a fully retracted position wherein the amount of projection of said second member out of said first member is minimized; and a source of gas under pressure which is responsive to a manually manipulatable member disposed on said hand grip portion, said source being fluidly communicated with said first member for supplying a gas under pressure thereinto and for producing the gas pressure which causes said elongate member to extend out of said first elongate member.

2. A device as set forth in claim 1, wherein said third member comprises a knob which can be attached to the outboard end of said second member.

3. A device as set forth in claim 1, wherein third member comprises a cutter, chisel, or metal shearing attachments.

4. A device as set forth in claim 1, wherein said device is a police baton.

5. A device as set forth in claim 1, wherein said source comprises a cylinder of compressed gas which is separate from said device and which is fluidly connected with said device by a conduit.

6. A device comprising:

a first elongate member having a hand grip portion;

a second elongate member reciprocatively disposed in said first member in a manner to define a telescopic arrangement, said second member having an inboard end disposed in said first member and an outboard end, said second member being adapted to be driven by gas pressure in said first member so as to be displaced within said first member and to extend out of said first member by a predetermined distance, said second member being hollow and effective to interchangeably receive a projectile therein or have a third member rigidly connected to the outboard end;

a spring disposed in said first member for biasing said second member toward a fully retracted position wherein the amount of projection of said second member out of said first member is minimized; and a source of gas under pressure which is responsive to a manually manipulatable member disposed on said hand grip portion, said source being fluidly communicated with said first member for supplying a gas under pressure thereinto and for producing the gas pressure which causes said elongate member to extend out of said first elongate member; wherein said source comprises:

a magazine operatively associated with said first elongate member, said magazine containing a plurality of gas generating cartridges: and a firing mechanism which is responsive to said second member assuming said fully retracted position to cause said plurality of gas generating cartridges to sequentially detonate and generate gas within said first member.

7. A device comprising:

a first elongate member having a hand grip portion;

a second elongate member reciprocatively disposed in said first member in a manner to define a telescopic arrangement, said second member having an inboard end disposed in said first member and an outboard end, said second member being adapted to be driven by gas pressure in said first member so as to be displaced within said first member and to extend out of said first member by a predetermined distance, said second member having a hollow projectile receiving portion for receiving a projectile therein formed in said second member or having a third member rigidly connected to the outboard end;

a spring disposed in said first member for biasing said second member toward a fully retracted position wherein the amount of projection of said second member out of said first member is minimized; and a source of gas under pressure which is responsive to a manually manipulatable member disposed on said hand grip portion, said source being fluidly communicated with said first member for supplying a gas under pressure thereinto and for producing the gas pressure which causes said elongate member to extend out of said first elongate member;

wherein said third member includes an inflatable member, said inflatable member being fluidly communicated with a chamber defined between said first and second members, in a manner which permits air in said chamber to be displaced into said inflatable member when said second member is driven to extend out of said first member in response to the generation of gas in said first member.

8. A device comprising:

a first elongate member;

a second elongate member reciprocatively disposed in said first member in a manner to define a telescopic arrangement;

a source of gas under pressure operatively disposed in said first member which is responsive to a manually manipulatable member disposed on said first member and which selectively releases gas under pressure into said first member in a manner which drives said second member to slide in said first member and to project outward; and a knob disposed at an end of said second member which is effective for delivering a non-fatal disabling impact to a human body;

wherein said knob is provided with an inflatable member, said inflatable member being supplied with a gas when said second member is driven to slide in said first member.

9. A device as set forth in claim 8, wherein gas within said first member is supplied to said inflatable member by way of a passage formed in said second member.

10. A device comprising:

a first elongate member;

a second elongate member reciprocatively disposed in said first member in a manner to define a telescopic arrangement;

a source of gas under pressure operatively disposed in said first member which is responsive to a manually manipulatable member disposed on said first member and which selectively releases gas under pressure into said first member in a manner which drives said second member to slide in said first member and to project outward; and a knob disposed at an end of said second member which is effective for delivering a non-fatal disabling impact to a human body;

wherein said source of gas under pressure comprises a magazine containing a plurality of gas releasing units.

11. A device as set forth in claim 10, further comprising a gas pressure operated mechanism which is responsive to gas pressure generated in said first member and which is operatively connected with said magazine for preparing a fresh unit ready for gas generation.

12. A device as set forth in claim 10, wherein said magazine is disposable and can be removed and replaced with a new magazine.

13. A device as set forth in claim 10, wherein said gas releasing units can be selected to release different amounts of gas.

14. A device as set forth in claim 10, wherein said magazine is rotatable.

15. A device as set forth in claim 10, wherein said gas releasing units contain explosive which combust to produce gas under pressure.

16. A device comprising:

a handle;

an elongate essentially cylindrical barrel fixedly connected to said handle;

an elongate hollow cylindrical ram reciprocatively disposed in said barrel;

a spring for biasing said ram to slide into said barrel;

a knob removably attached to an outboard end of said ram, said knob being so dimensioned as to be effective to disperse the impact which is applied to a human body, said knob having an expandable elastomeric cover disposed thereover in a manner to be inflatable in response to the supply of air under pressure through a bore which extends axially along said ram, said knob being removable to allow one of (a) a projectile to be loaded into the bore in said ram through an open end of said ram, and (b) a cutter or chisel to be attached to said ram in place of said knob;

a stepped piston slidably disposed in said barrel and connected to an inboard end of said ram, said stepped piston having a first face which is exposed to a gas pressure selectively developed in said barrel and a second face which is exposed to an annular space which is defined between said barrel and the outer periphery of said ram; and passage means including the bore in said ram, for delivering air in said annular space to inflate said inflatable elastomeric cover when said ram is driven to extend out of said barrel in response to the application of a gas pressure on said first face.

17. A device as set forth in claim 16, wherein said spring is disposed in said annular space.

18. A device as set forth in claim 16, further comprising gas pressure generating means disposed in one of said handle and said barrel, said gas pressure generating means including a plurality of gas releasing units, said gas pressure generating means being arranged to enable sequential generation of a gas pressure in said barrel which acts on said first face.

19. A device as set forth in claim 16, further comprising a gas by-pass for selectively relieving a portion of the gas pressure which acts on said first face so as to reduce the force with which said ram is forced to slide in said barrel in a direction which causes said ram to project out of said barrel.

* * * * *